United States Patent [19]

Gleditsch

[11] Patent Number: 4,903,764

[45] Date of Patent: Feb. 27, 1990

[54] SWIVELSUB

[76] Inventor: Svein Gleditsch, 9420 Lundens, Norway

[21] Appl. No.: 220,555

[22] Filed: Jul. 18, 1988

[30] Foreign Application Priority Data

Jul. 27, 1987 [NO] Norway ..... 873143

[51] Int. Cl.[4] ..... E21B 29/12

[52] U.S. Cl. ..... 166/78; 166/117.7; 166/356

[58] Field of Search ..... 166/78, 55, 82, 88, 166/97, 117.7, 356, 361; 175/322

[56] References Cited

U.S. PATENT DOCUMENTS 3,301,324 1/1967 Smith ..... 166/78
3,765,485 10/1973 Regan ..... 166/78
3,805,894 4/1974 Giroux ..... 166/78

OTHER PUBLICATIONS

Information Brochure for Mercur Annular Swivelsub.

*Primary Examiner*—Stephen J. Novosad
*Assistant Examiner*—Terry Lee Melius
*Attorney, Agent, or Firm*—Ladas & Markarian

[57] ABSTRACT

A swivelsub comprising a sleeve member which is sealable and lockable by means of the annular preventer of a blowout preventer, with at least one end portion of the sleeve being lockable to the drill string, and with means providing sealing and enable relative rotational movement between said sleeve member and the drill string. The swivelsub forms a sealable and pressure controlling passage for a dril string in a drilling well and is particularly useful for cutting operation of casings in an abandoned well.

5 Claims, 4 Drawing Sheets

SWIVELSUB

The present invention relates to a drill string swivel or swivelsub which provides a sealable and pressure controlling passage for a drill string extending through a blowout preventer, a well head and into a well borehole. The swivelsub is particularly suited for cutting casings in an abandoned well.

In offshore exploration drilling operations wells are drilled down through the subsurface earth formations. As the drilling operations progress casings are run into the bore hole in order to restrain the surrounding formations and, simultaneously provide guidance for the drill string. The first drilling phase is carried out with drill bits of relatively large dimensions, and the bore hole is subsequently provided with casings having correspondingly large dimensions, e.g 30". In the subsequent drilling operations drill bits with decreasing smaller dimensions are used and the well is provided with casings of corresponding smaller dimensions. This results in a stepped reduction of the casing dimensions as drilling operations reach greater depths. Thus, when drilling operations are completed, several casings are located outside one another immediately below the sea floor or in the proximity of the well head.

Today, the authorities do not permit the well head with associated casings to be left on the sea floor after completed exploration drilling. The casings have to be cut below sea floor level and the well head including the casings portions and associated equipment is retrieved and removed from the sea floor. Casings are commonly cut approximately 10 m below sea floor level.

At present no method is existing, for cutting casings in a controlled manner without preliminary perforating the casing to check whether there is a pressure build-up between the casing to be cut and the adjacent surrounding casing. Commonly, a pressure build-up is expected between casings of one dimensions and the next externally located casings. To ensure that the high gas pressure between the casings is not able to cause a blowout the casing is normally perforated just above the cutting area. Perforating is done before the cutting operation. In advance of perforating a blowout preventer is closed to avoid a blowout. If no pressure build up occurs the blowout preventer may be reopened and the perforation gun can be retrieved from the well. Subsequently the cutting equipment proper is inserted and the casing is cut and the upper severed portion is removed from the well. In the same way the adjacent larger size casing is removed and the operations continue with casings of increasing dimensions until all casings are cut and the sea floor is free of any equipment. If perforating before cutting is omitted a hazard of a sudden pressure build-up as the cutting blades cut through the casing is present. In order to counteract this hazard the blowout preventer has to be closed during cutting operations. In practice this is not possible without impairing the blowout preventer, since a stationary expandable rubber gasket or packer would have to be locked around a rotating drill string.

This previously known method involving perforating the casing and, possibly, cementing, requires relatively time consuming operations and, consequently loss of rig time and increasing costs for the rig operator.

By means of the swivelsub according to the present invention, primarily the damage of the blowout preventer is avoided. Additionally, it is fully possible to save 6–24 hours of rig time due to the fact that the preliminary perforating of casings is avoided. Completely controllable cutting operations may be carried out with the swivelsub according to the invention.

This is achieved according to the invention by means of a swivelsub of the aforesaid kind, which is characterized by the fact that said swivelsub is externally sealable by means of an annular preventer of the blowout preventer and is internally sealed from said drill string or mandrel, said drill string being rotatable but axially retained within said swivelsub.

The swivelsub suitably comprises a sleeve member which is sealable and lockable by means of the annular preventer with at least one end portion of the sleeve being lockable to the drill string, and means providing sealing and permitting relative rotational movement between said sleeve member and the drill string.

In use the sleeve member is tightened and locked by means of surrounding expansion gland packings, i.e. of the kind present in an annular preventer.

The lockable end portion of the sleeve is suitably a separate split locking collar which may be attached around a drill string.

Advantageously, the means for sealing and relative rotational movement comprise thrust bearings and radial bearings and one or a plurality of seals cooperating with the sleeve member and the throughrunning drill string.

The drill string in question may be a specially prepared pipe section with external portions complementary with internal portions of the locking collar and it may have portions with a smooth surface for cooperation with said seals.

The sleeve member may, advantageously, be provided with through passages in the sleeve wall for filling oil in the space formed between the inner wall of the sleeve and the outer wall of the drill string.

Other and further objects, features and advantages will appear from the following disclosure of an embodiment of the invention at present preferred and shown in the accompanying drawings for illustration.

Figure 8:
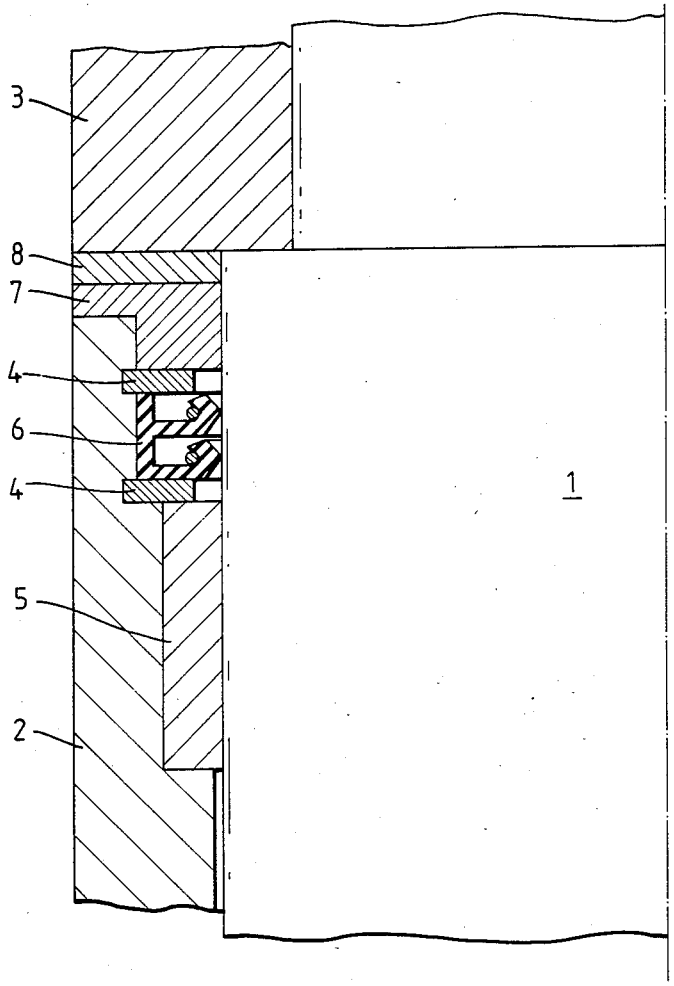

FIG. 8 presents the arrangement of bearings and seals against the drill string portion in more detail.

Figure 1:
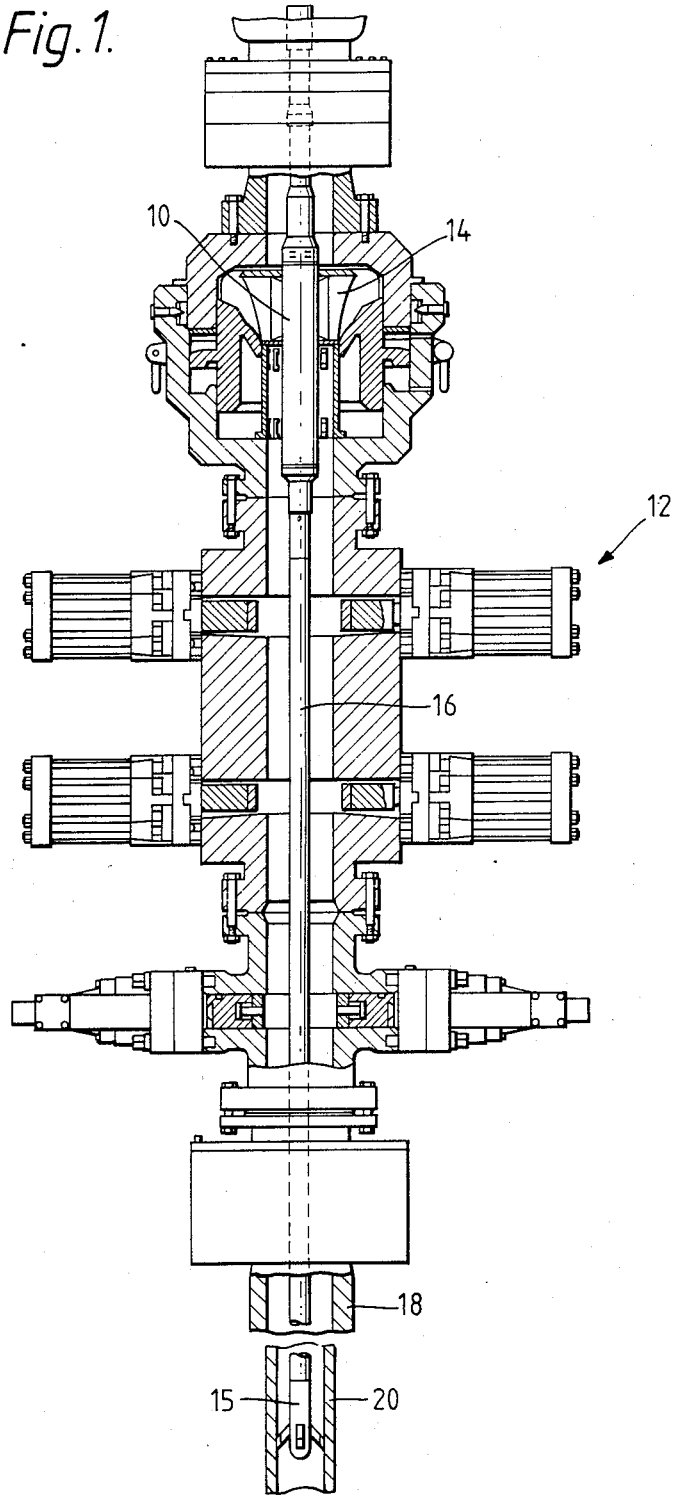
FIG. 1 is an elevational section through a blowout preventer including the swivelsub according to the invention.

Referring to FIG. 1 sectional view of a blowout preventer 12 provided on a well head 18 is illustrated. From well head 18 one or a plurality of casings 20 extend down into the subsea earth formations. In the upper portion of blowout preventer 12 an annular preventer 14 is provided. Commonly, the latter is intended for sealing off the annulus between the drill string 16 and the inside passage through the annular preventer 14. The drill string, or more precisely, the cutting string 16 extends through the entire blowout preventer 12 with the lower end of the cutting string 16 being provided with a cutting tool 15 for cutting casing or casings 20. The swivelsub or drill string swivel 10 is interposed to cutting string 16 at a predetermined level relatively cutting tool 15 and in level with the annular preventer 14. The annular preventer 14 is normally provided with expandable rubber packings or packers which, when activated, is surrounding and sealing off the drill string. This inherent nature is utilized in the present invention in that the expandable packers are activated to embrace the swivelsub and consequently shut off the anulus in order to enable control of the well pressure.

Figure 2:
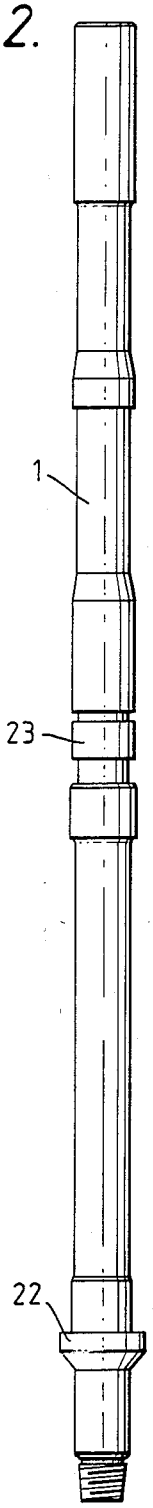
FIG. 2 presents the drill string portion.

For a more detailed disclosure of swivelsub 10 it is referred to FIG. 2 which is a diagrammatical view of the drill string portion or mandrel 1 of the swivelsub 10. This portion comprises a steel core having an internal bore diameter of 71 mm in order to enable liquid to be circulated through the core. The mandrel has a 4.5" I.F. A.P.I. threaded portion at both ends (box and pin). At the lower end (FIG. 2) a shoulder is provided to receive axially directed thrust forces of the swivelsub. At the upper end of the mandrel machined profile are provided which are adapted for standard slips and lifting elevators (not shown).

Figure 3:
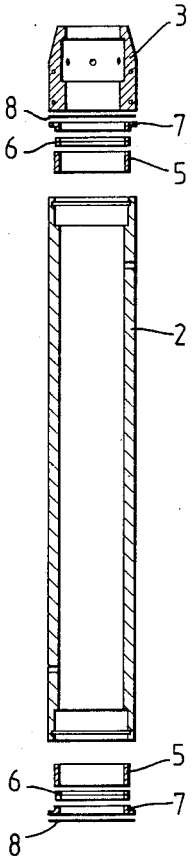
FIG. 3 is a longitudinal section through the sleeve member and the locking collar according to the invention.

FIG. 3 is a sectional view of sleeve member 2 which is provided outside the mandrel 1 and is contacting shoulder 22 with its lower end portion. A splittable locking collar 3 is located at the opposite end of sleeve 2. The locking collar 3 has a internal shape which is complementary to a flange portion on the mandrel 1, as shown in FIG. 2. Each end of the sleeve 2 is provided with thrust bearings, radial bearings and seals provided for cooperation with locking collar 3, shoulder 22 and mandrel 1, respectively.

Figure 4:
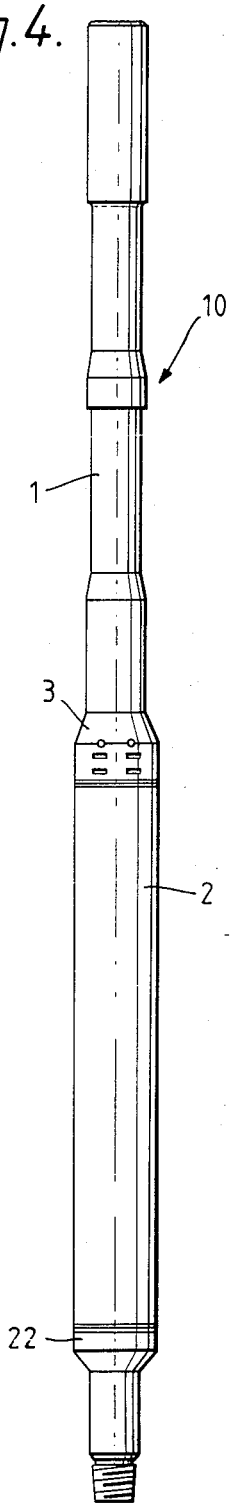
FIG. 4 is a diagrammatical view of the sleeve and the collar of FIG. 3, mounted on the drill string portion of FIG. 2.

FIG. 4 illustrates the assembled swivelsub 10 with sleeve 2 enclosing a spaced portion of the drill string 1. The lower end of sleeve 2 is in contact with shoulder 22, and locking collar 3 is clamped about the mandrel 1. Locking collar 3 and shoulder 22 are, thus, stationary relative to the mandrel 1 and rotatable relative to the sleeve member 2. As mentioned, sleeve member 2 is intended to be fixedly restrained by expanding rubber packers in the annular preventer 14. In this way the sleeve member 2 may be kept stationary and the annulus may be shut off at the same time as it is possible to rotate the mandrel 1 or the cutting string 16.

Figure 5:
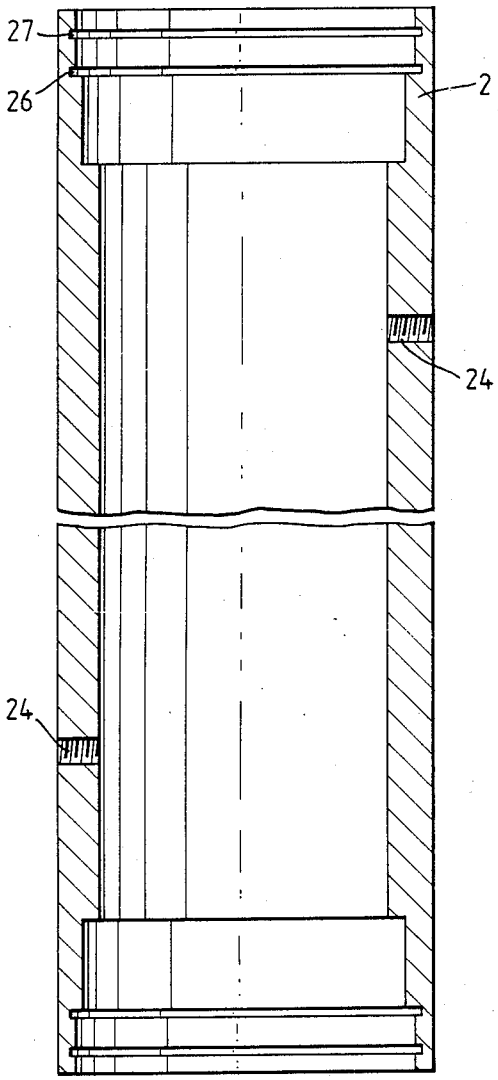
FIG. 5 is a more detailed view of the sleeve member according to FIG. 3.
Figure 6:
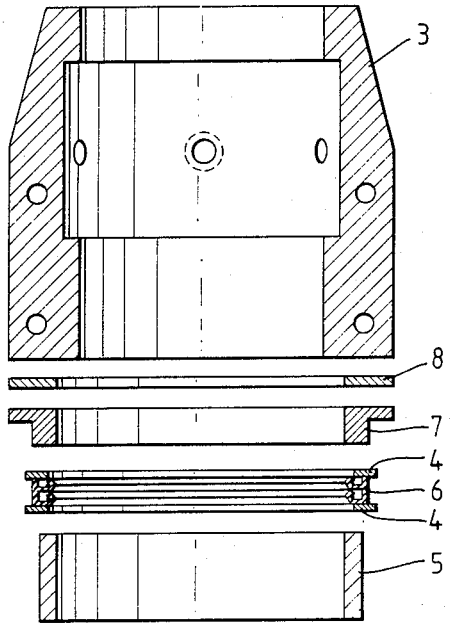
FIG. 6 is a sectional view of the locking collar of FIG. 3 presented in more detail with associated seals and bearings.
Figure 7:
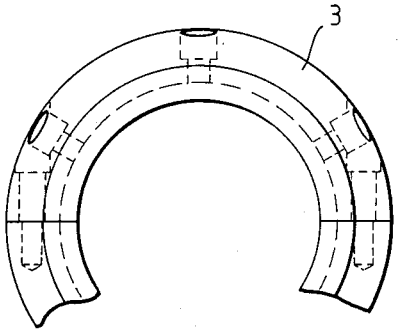
FIG. 7 is a cross sectional of the locking collar of FIG. 6.

FIG. 5 is a longitudinal section of sleeve 2 in more detail. Apertures 24 are indicated for filling, preferably light oil, into the annulus between the mandrel 1 and the internal wall of sleeve member 2. It will also appear from the Figure how bearings and seals are to be assembled in the end portions of sleeve 2. The components are presented in in FIG. 6, in the correct sequence of assembly where radial bearing 5 is initially inserted into sleeve 2. Said bearing or bushing may, e.g. be manufactured from Ni-bronze. Then a retaining ring 4 is inserted into a groove 26 provided in the sleeve 2, followed by a suitable seal 6, and another retaining ring 4 intended for location in a corresponding groove 27 on sleeve 2. An internal bearing 7, e.g. made of polyacetate-pom, is thereafter inserted to form a bearing face for axial forces. Finally, an external bearing 8, e.g. made of polyacetate-pom, is located between internal bearing 7 and locking collar 3. As will be apparent from FIGS. 6 and 7, the attachment of the locking collar 3 on the mandrel 1 may be provided by bolts and bolt holes, is indicated. FIG. 8 illustrates in further detail the order in which the bearing and sealing components and assembled in sleeve 2 and their engagement with the mandrel 1. Thus it appears from the shown embodiment that bearings and seals are kept stationary in relation to the sleeve 2, but the arrangement may naturally be the opposite, i.e. said components may be stationary on the mandrel 1, though this arrangement is appearing as less convenient.

Having described my invention, I claim:

1. A swivelsub, for use with an annular preventer of a blowout preventer, said annular preventer having expandable rubber elements to seal off the drill string and to provide a sealable and pressure controlling passage for a drill string, comprising:

a sleeve member, positioned around said drill string and surrounded by said annular preventer so as to be lockable by said annular preventer and sealable by said expandable rubber elements of said annular preventer;

retaining means, positioned at one end of the sleeve member, for locking around said drill string for rotation therewith; and means, positioned at at least one end of the sleeve member, for enabling relative rotation between the sleeve member and the drill string.

2. A swivelsub as defined in claim 1 wherein said retaining means is a separate split locking collar for clamping around said drill string.

3. A swivelsub as defined in claim 1 wherein the means to enable the relative rotation between the sleeve member and the drill string comprise at least one radial bearing, thrust bearing and at least one seal positioned between the sleeve member and the drill string and between the retaining means and the sleeve member.

4. A swivelsub as defined in claim 1 wherein said drill sting is a especially prepared pipe section with external portions designed to be complementary to internal portions of said locking collar.

5. A swivelsub as defined in claim 1 wherein said sleeve member is provided with through passages for filling oil into an annulus between an internal wall of the sleeve and an external wall of the drill string.

* * * * *